US005167349A

United States Patent [19]

Rodder et al.

[11] Patent Number: 5,167,349

[45] Date of Patent: Dec. 1, 1992

[54] TUBE FOLDING DEVICE AND METHOD FOR USING SAME

[75] Inventors: Jerome A. Rodder, 775 Sunshine Dr., Los Altos, Calif. 94022; Gail A. Turner, Mountain View, Calif.

[73] Assignee: Jerome A. Rodder, Los Altos, Calif.

[21] Appl. No.: 801,647

[22] Filed: Dec. 2, 1991

Related U.S. Application Data

[63] Continuation-in-part of Ser. No. 636,733, Jan. 2, 1991, abandoned, which is a continuation-in-part of Ser. No. 453,124, Dec. 5, 1989, abandoned, which is a continuation-in-part of Ser. No. 295,480, Jan. 10, 1989, abandoned.

[51] Int. Cl.[5] ..... B65D 35/24

[52] U.S. Cl. ..... 222/107; 428/40; 222/1

[58] Field of Search ..... 222/92, 95, 99, 100, 222/103, 104, 107, 1; 428/40

[56] References Cited

U.S. PATENT DOCUMENTS

| | | | |
|---|---|---|---|
| 1,754,403 | 4/1930 | Revbush | 222/99 |
| 2,764,829 | 10/1956 | Kingman | 222/92 X |
| 2,765,998 | 10/1956 | Engert | 428/40 X |
| 3,199,737 | 8/1965 | Koffler | 222/99 |
| 3,211,342 | 10/1965 | Miles | 222/107 |
| 3,913,655 | 10/1975 | Ogino | 428/40 |

FOREIGN PATENT DOCUMENTS

| | | | |
|---|---|---|---|
| 3430677 | 11/1985 | Fed. Rep. of Germany | 222/107 |
| 701423 | 12/1953 | United Kingdom | 222/99 |

*Primary Examiner*—Kevin P. Shaver

*Attorney, Agent, or Firm*—Christie, Parker & Hale

[57] ABSTRACT

A device for maintaining collapsible dispensing tubes, particularly plastic tubes, in folded configurations comprises a strip of adhesive material and a release liner removably attached to the upper surface of the strip comprising three adjacent and separated release liner sections. A method of folding up the collapsible dispensing tube comprises exposing a portion of the adhesive material and folding the proximal end of the tube toward the distal end of the tube and attaching the proximal end of the tube to the adhesive sections, successively exposing portions of the adhesive strip and folding the proximal end towards the distal end of the tube along a folding line located a short distance from the previously attached proximal end of the tube.

8 Claims, 5 Drawing Sheets

62
94
95
92
25
66
78a
70
67
60
80
72
78b
82
74
84
64
52a
52b
52c
52
50
52d
54
20
25
16
10
12
14

TUBE FOLDING DEVICE AND METHOD FOR USING SAME

CROSS-REFERENCE TO RELATED APPLICATIONS

This is a continuation-in-part of U.S. patent application Ser. No. 07/636,733, filed Jan. 2, 1991, now abandoned, which is a continuation-in-part of U.S. patent application Ser. No. 07/453,124, filed Dec. 5, 1989, now abandoned, which is a continuation-in-part of U.S. patent application Ser. No. 07/295,480, filed Jan. 10, 1989, now abandoned, all of which are incorporated herein by this reference.

BACKGROUND OF THE INVENTION

This invention relates to devices and methods for folding up collapsible dispensing tubes and maintaining them in a folded configuration.

Collapsible tubes are commonly used as containers and dispensers for toothpaste, shampoo, shaving cream and the like. Because such containers have minimal structural rigidity, they become easily deformed with repeated use. Such deformation often hinders further dispensing of the tube's contents, and results in waste and tube rupture.

Metal dispensing tubes are typically folded up, sometimes with devices to assist in folding, because metal tubes tend to retain their shape after folding. Plastic dispensing tubes are more attractive to consumers, but a plastic tube tends to unfold after the tube is folded to dispense its contents. Thus, plastic dispensing tubes are commonly rolled up when dispensing the contents.

Devices for winding or coiling the end of a collapsible tube are known in the art and provide a means for reducing the problems described above. U.S. Pat. No. 955,530 to Morrison shows a key-like device that engages the sealed end of a collapsible tube and is used to coil the tube upon itself as the tube contents are dispensed from the opposite end. Similar devices are shown in U.S. Pat. No. 2,162,295 to Benedict and U.S. Pat. No. 2,809,770 to Neimy, et al. These references each disclose a device that comprises a tube-engaging means (typically, a slot) and a handle for use in coiling up the tube.

A common drawback to the use of such devices is that as the tube is rolled up, it becomes increasingly difficult to continue coiling the tube, because of the internal resistance of the tube, and the circular cross-sectional shape of the coiled end. Additionally, the devices described above are somewhat expensive and difficult to manufacture and they are not disposable.

U.S. Pat. No. 3,199,737 to Koffler describes a clip-like device for use with collapsible dispensing tubes. The device clamps onto the sealed end of a dispensing tube, and is used to roll up the tube as the tube contents are dispensed. The Koffler device suffers from disadvantages similar to those previously mentioned. Although the Koffler device avoids formation of a generally circular cross-sectional shape as a tube is rolled up, the irregular shape of the device still makes it increasingly difficult to continue rolling up the dispensing tube. As with the earlier mentioned references, the Koffler device is not inherently inexpensive and easy to manufacture or disposable.

German publication DE 3430677 to Ariz describes a plastic dispensing tube having a double-sided adhesive strip on it for holding the tube in a rolled-up configuration. Because the tube is rolled up, rather than folded, it suffers from the drawback of being difficult to use, for the above reasons. As the roll-diameter increases, the adhesive is not as effective in holding the tube in its rolled up form. There are many devices used to assist in rolling up a plastic tube, but without much success.

Accordingly, a need exists for a convenient low-cost tube dispenser, especially for plastic dispensing tubes, that can effectively be used in dispensing the contents of the tube.

SUMMARY OF THE INVENTION

The present invention provides a tube folding device and method for maintaining a collapsible dispensing tube in a folded configuration, and comprises an adhesive strip, attachable to the tube, bearing a release liner comprised of detachable sections. Each section is removed intermittently by grasping a tab extending from the release section and peeling the section off the adhesive strip. As the contents of the tube are dispensed, the tube is folded up about itself and each fold is secured in place by sequentially exposing portions of the adhesive and pressing the folded end of the tube against the exposed adhesive. In one embodiment, the tube is folded sequentially and each fold in the sequence is folded up to the next release liner in the sequence which produces a loose folding of the dispensing tube.

A collapsible dispensing tube equipped with the present invention is conveniently and efficiently folded up about itself and held in the folded configuration. The adhesive strip and tabbed, sectioned release liner are inexpensively and conveniently manufactured and used. Because plastic tubes equipped with the invention are folded up rather than rolled up, particularly by the loose folding technique, the adhesive is effective in maintaining the tube in its folded form, waste is reduced and ease of use is facilitated.

DETAILED DESCRIPTION

Figure 1:
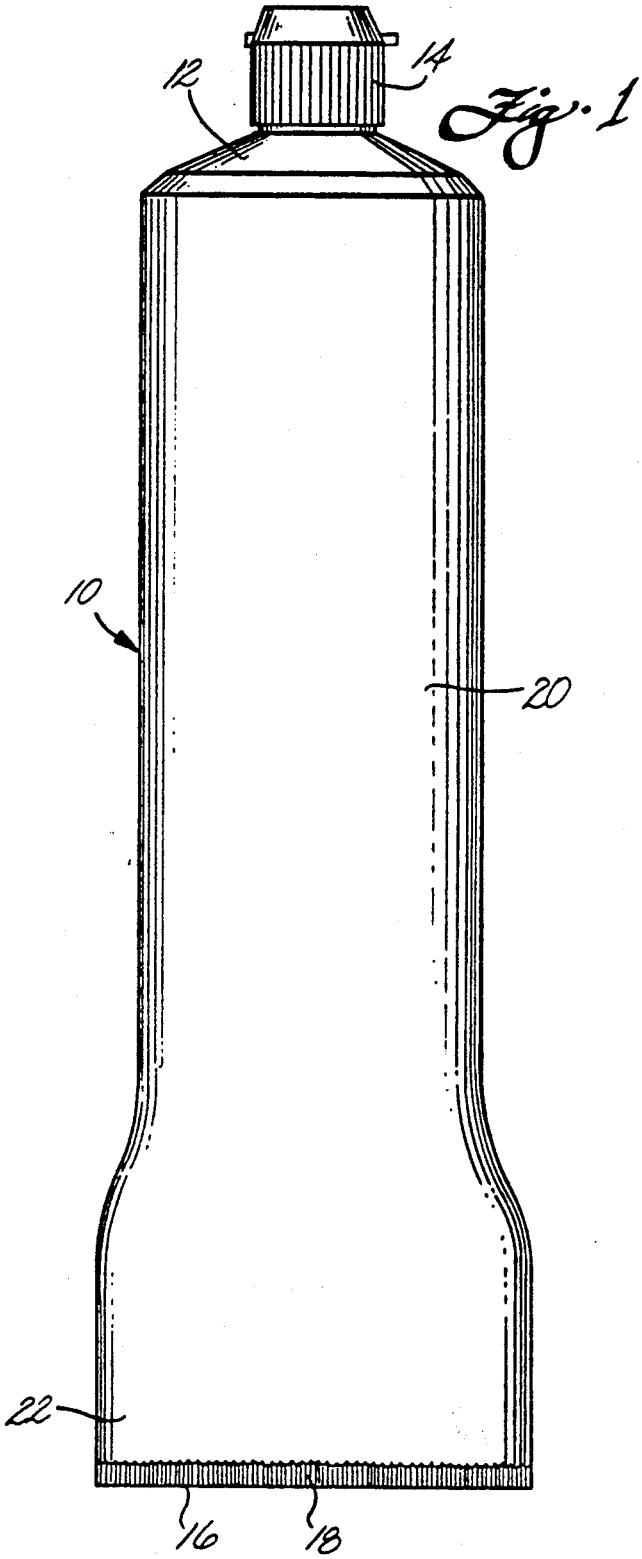
FIG. 1 is an elevation view of a collapsible dispensing tube.

A typical collapsible dispensing tube 10 is shown in FIG. 1. The majority of tubes today are commonly manufactured from plastic, however a few are still made from metal foil, and are used to package toothpaste, shampoo, etc. The tube has a distal end 12, with a cap 14 thereon, and a sealed proximal end 16. The proximal end is typically crimped at 18 to prevent leakage of the tube contents. The proximal end of the tube merges into a cylindrical body 20 of the tube, via a generally flat tail portion 22.

Typically, as the contents of the tube are removed, the proximal end of the tube is folded or rolled forward. A tube made from metal foil generally can be folded upon itself satisfactorily, but tubes made of plastic cannot because the plastic laminate material is resistant to folding.

Figure 2:
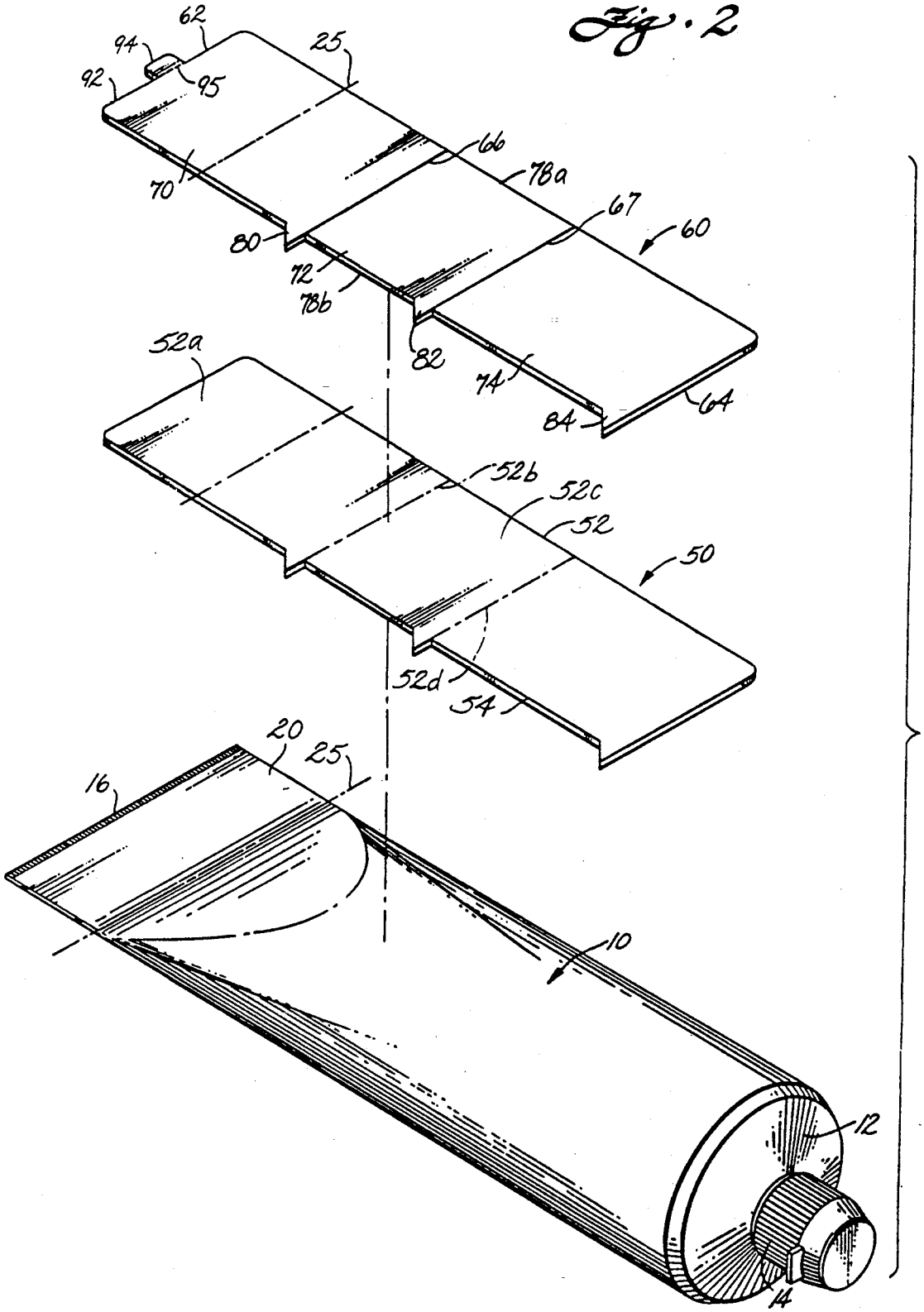
FIG. 2 is an exploded perspective view of a collapsible tube and an adhesive strip and a sectional release liner.
Figure 3:
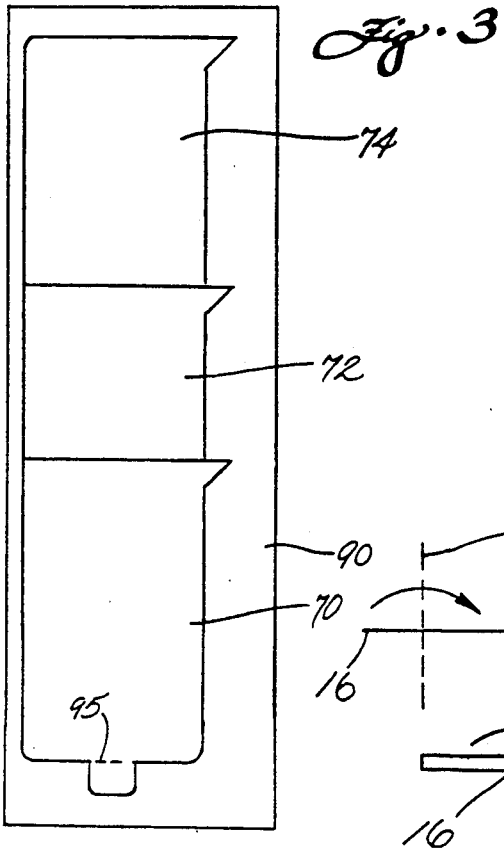
FIG. 3 is a semi-schematic view of an adhesive strip, release liner, and backing.

FIGS. 2 and 3 show the present invention, which can be used with collapsible dispensing tubes in general, but is especially useful with plastic tubes which have a greater tendency to unfold from a folded configuration. The invention is useful in folding up a plastic tube about itself as the contents of the tube are removed. A long, generally rectangular strip of pressure-sensitive adhesive material 50 is affixed lengthwise to the collapsible dispensing tube and provides means for holding the tube in a folded configuration. In one embodiment, the strip of adhesive material is a double-sided tape having an upper surface 52 and a lower surface 54. The lower surface is adhered to the dispensing tube. A protective release liner 60 covers the upper surface of the adhesive strip until portions thereof are exposed and used to secure the tube in a particular folded configuration.

The release liner 60 has a proximal end 62 and a distal end 64, and is nearly as long as the dispensing tube. A plurality of continuous, longitudinally spaced apart and parallel transverse cuts 66, 67, etc., across the width of the release liner divide the release liner into adjacent release liner sections 70, 72, 74, etc. In the illustrated embodiment, there are two severance lines, and three release liner sections 70, 72, and 74, are thereby formed. Other embodiments are described below.

Each release liner section has a pair of opposed, parallel, lateral edges 78*a* and 78*b*. At least one tab 80, 82, and 84 extends from a lateral edge of each release liner section and is integral therewith. It has been found that the release liner sections are more easily removed from the adhesive material when each tab is located adjacent the transverse cuts 66 that divide the release liner into sections. Each tab has a right triangular shape which extends slightly from the lateral edge of the release liner. The tab has been designed to enable a fingernail of the user to easily lift the tab to enable the removal of a section. The tab is made from the same material as the release liner and because of the shape, can contain adhesive underneath and still function properly. The advantage of this design is that when manufactured, the adhesive can be applied over the entire surface of the release liner without having to make sure that the tab is free from adhesive. The tabs provide means for lifting the release liner sections off the strip of adhesive material 50, according to the procedure described below.

Adhesive strips and release liners of the above type are conveniently and inexpensively manufactured, particularly if the length and width of both (excluding the tabs) are the same. They can be applied to a collapsible dispensing tube either manually or by an automated process.

Automated adhesive bonding of the adhesive strip and release liner to the tube can occur, for example, in the same factory where the dispensing tube is made and/or filled with its contents. In such a case, the lower surface 54 of the strip of adhesive material 50 is exposed prior to application, and the strip is simply pressed against the tube, lengthwise, by machinery. The tube is then packaged and sold.

If the adhesive strip and release liner are manually applied, i.e., by a consumer, they are present as a package insert (placed, e.g., in the box in which the tube is sold), or packaged and sold separately. In either case, the lower surface 54 of the strip 50 is protected with a second or "bottom" release liner or backing 90, as shown in FIG. 3. This bottom release liner is removed by the consumer, thereby exposing the tacky lower surface of the strip of adhesive material, prior to application of the strip to the tube. The strip 50 and tube are conveniently aligned lengthwise with the tube by placing the proximal edge 92 of the first release liner section 70 in line with the sealed proximal end 16 of the tube.

Manual application and alignment of the strip of adhesive material 50 and sectional release liner 60 are facilitated by the presence of a bottom tab 94 integral with and extending from the proximal edge 92 of the first release liner section 70. The tab 94 is held with the fingers of one hand while the opposite end of the strip of adhesive material and release liner is held with fingers of the other hand. The adhesive strip and release liner are then placed on and affixed to the tube, using the tab 94 to align the proximal edge 92 of the release liner 60 and the proximal edge of the adhesive strip 50 with the proximal end 16 of the collapsible dispensing tube. The bottom tab 94 is then folded under, or detached along, a perforated line 95.

After affixing a strip of adhesive material and its sectional release liner to a collapsible dispensing tube, the tube is folded up, used and held in folded configurations, in the following manner.

After some of the tube's contents have been removed, the first section 70 of the release liner 60 is removed by grasping the tab 80 extending therefrom and peeling the section 70 away from the strip of adhesive material 50 along the first dividing line cut 66. This exposes a first section 52*a* of the upper surface 52 of the adhesive strip 50. The end of the first adhesive section 52*a* is shown in phantom lines at 52*b* in FIG. 2.

The flat proximal end 16 of the tube is first folded towards the tube's distal end 12 about a first fold line 25 which is approximately in the middle of the first adhesive section 52*a*, using the tube itself as a fulcrum. The tube is folded so the end 16 of the tube is placed near the end 52*b* of the first adhesive section 52*a*. The two folded halves of the first adhesive section face one another and are pressed together to adhere the two sections by the self adhesion of the folded-over first adhesive section 52*a*.

After some more of the tube's contents have been squeezed out of the tube, the second section 72 of the release liner 60 is removed by grasping the tab 82 extending therefrom, and peeling the second section away along the second line 67. This exposes a section portion 52*c* of the adhesive strip. The end of the second adhesive section 52*c* is shown in phantom lines at 52*d* in FIG. 2. The tube is folded so the end of the tube reaches the second end 52*d* of the exposed adhesive, and the folded tube is pressed against and affixed to the second exposed portion 52*c* of adhesive along the second end 52*d*.

The process is repeated until the tube is completely folded up.

It will be noted that the positions of the adhesive strip and release liner relative to the proximal end of the tube, as well as the location of the first and subsequent fold lines, can result in undesired overlap of a folded portion of the tube and not-yet-exposed sections of the release liner. To reduce this problem, a dispensing tube equipped with the strip of adhesive material and sectional release liner just described is folded in "loose folds" rather than "tight folds." The difference is schematically illustrated in FIGS. 4 and 5.

Figure 4:
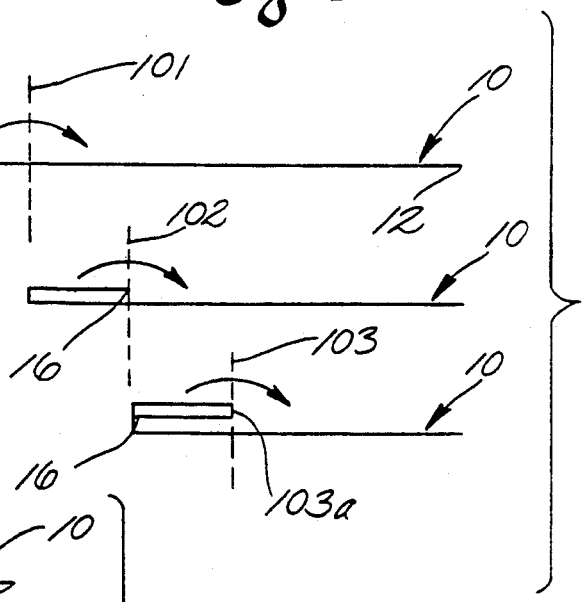
FIG. 4 is a schematic illustration of the method of tight folding.
Figure 5:
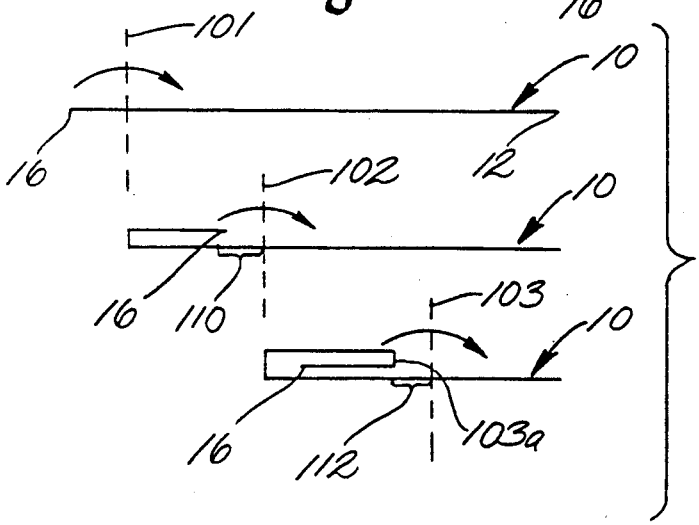
FIG. 5 is a schematic illustration of the method of loose folding.

In FIG. 4, a dispensing tube 10 is tightly folded. The first fold is accomplished by folding the proximal end 16 of the tube toward the tube's distal end 12 about a first fold line 101, using the tube itself as a fulcrum, just as described above.

A second fold line 102 is defined by the crimped edge of the dispensing tube, i.e., its proximal edge 16. Using this edge as a fulcrum, the tube is folded toward the tube's distal end, about the second fold line.

A third fold line 103 is defined by the distal edge 103*a* of the previously folded portion of the tube. Using this edge as a fulcrum, the tube is folded toward the tube's distal end, about the third fold line.

Subsequent folds are accomplished using previously folded portions of the tube as fulcrums. The problem encountered using a tight fold is that the thickness at the fulcrum is identical to the thickness along any point of the folded tube thus promoting a tendency to unfold as well as making it more difficult to remove the remaining contents of the tube.

In FIG. 5, a dispensing tube 10 is loosely folded, which is the preferred method. The first fold is achieved in the same manner as that described above, i.e., the proximal end 16 of the tube is folded toward the tube's distal end 12 about a first fold line 101 which is the middle of the first section, using the tube itself as a fulcrum. The second fold occurs at a second fold line 102, which is spaced a first distance 110 away from the end 16 of the dispensing tube. Rather than using the end 16 as a fulcrum, the tube is folded toward its distal end about the second fold line using the tube itself as a fulcrum.

Similarly, the third fold occurs at a third fold line 103, which is spaced a second distance 112 away from the distal edge 103*a* of the previously folded portion of the tube. Using the tube itself as a fulcrum, the tube is folded toward its distal end about the third fold line 103.

The actual location of the fold lines is determined by the person folding the tube. By allowing a short spacing distance between a given fold line and the previously folded portion of the tube, the method of loose folding reduces the importance of precise positioning of the release liner 60, and ensures easy removal of each of the release liner sections. More importantly, it avoids bunching of the tube sections when folded over on one another, allowing instead the folded over sections to lie in a flatter profile which can be more useful in dispensing all the contents and in adhesively retaining the folded tube sections in their folded-over positions.

Figure 6:
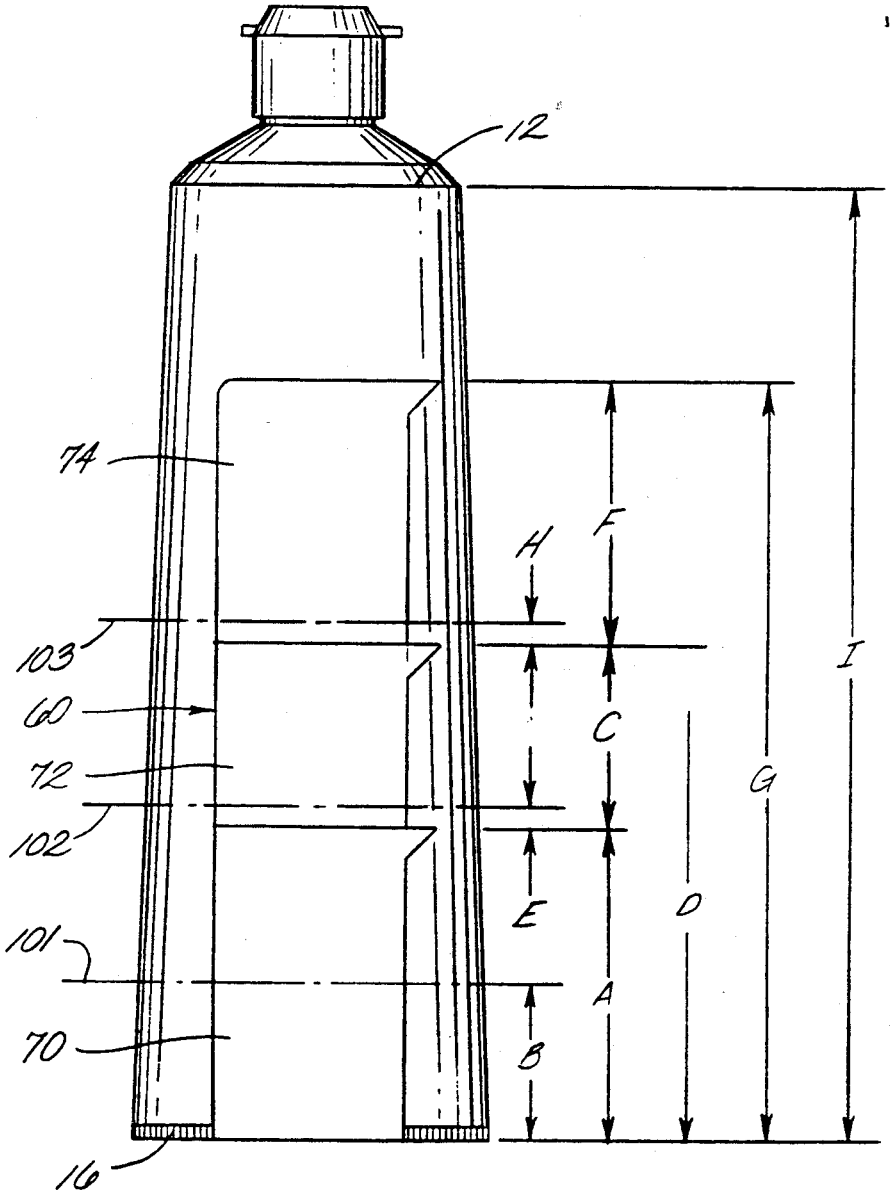
FIG. 6 is an elevation view of the adhesive strip with a release liner applied to a collapsible dispensing tube.

Referring to FIG. 6, a concrete example of the loose folding technique can be seen. This embodiment uses three side-by-side release liner sections on the adhesive strip. FIGS. 7A–7D, described below, show a different embodiment. The loose folding technique of FIG. 6 is accomplished by removing the first section 70 of the release liner 60. The first section has a length A which is 2.2 inches. The first fold is achieved by folding the proximal end 16 of the tube toward its distal end 12 about a first fold line 101, using the tube itself as a fulcrum. The first fold line has a length B of 1.1 inches, i.e., at the middle of the section 70.

The second fold is made by first removing the second section 72 of the release liner, which has a length C of 1.4 inches, and folding the tube up to length D which is located 3.6 inches above the original unfolded proximal end of the tube. By folding the tube up to length D, a space of 0.3 inch is left between the end of the tube at 16 and the first fold line at 101. By folding the tube so that the space E is left next to the end of the once-folded tube, the tube thickness at the fold line is less than at the middle of the fold which deters unfolding of the tube and makes it easier to remove the tube's contents.

The third and final fold is made by removing the third section 74 of the release liner which has a length F of 1.7 inches. The end of the tube is then folded up to length G, which is located 5.3 inches above the original unfolded proximal end of the tube. A space H of 0.3 inch is left between the previous end of the folded tube and the line at D. The thickness at the fold line is identical to the previous fold line thicknesses, while the thickness at the middle of the fold continues to increase, ensuring that the tube will remain folded. Although the thickness at the middle of each folded section increases, the tube thickness at the critical fold lines remains constant.

The illustrated loose folding method is used when the device is placed on a tube having length I, which is a standard 7 inch long toothpaste tube. It is to be understood that these embodiments can change as the size of the tube changes.

Figures 7A, 7B, 7C, 7D:
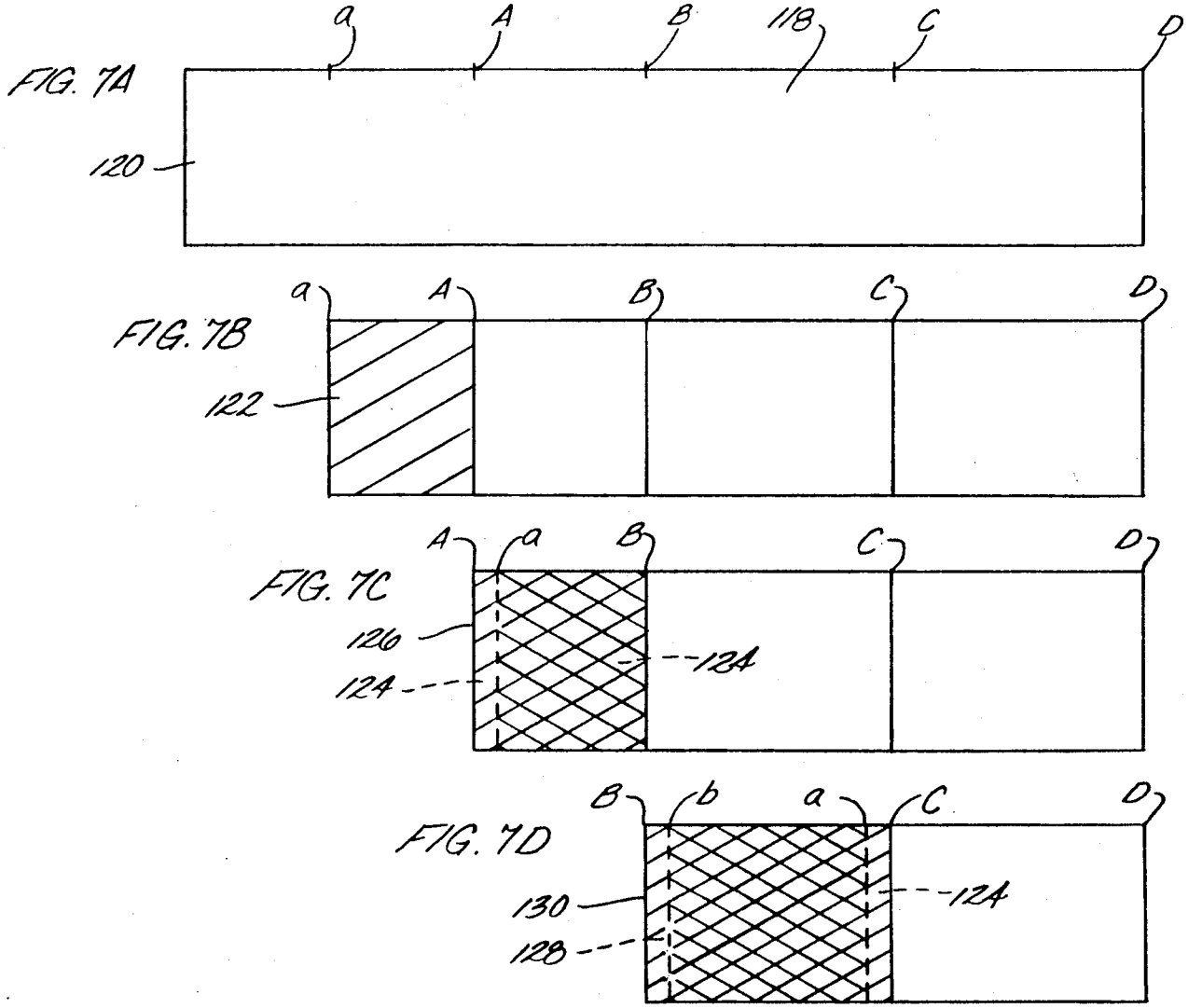
FIGS. 7A–7D are schematic views illustrating the steps in the process of folding up a dispensing tube.

FIGS. 7A–7D show, in plan view, schematically, an example of the loose folding technique for an adhesive strip 118 having three release liner sections extending most of the length of the dispensing tube. The ends of the release liner sections are at points A, B and C, which are at 2.2, 3.6 and 5.3 inches from the end of the adhesive strip 118. The point D is at the end of the tube, at about 7.0 inches from the opposite end of the tube. The space from C to D has no adhesive. The release liner sections, which are not shown in FIGS. 7A–7D, are removed successively in the manner described previously, exposing the adjacent adhesive sections of the release liner at intervals along the adhesive strip. The first adhesive section is folded over at its midpoint along a first fold line 120. The first section is 2.2 inches long and is folded along an axis a at 1.1 inches from the end of the adhesive strip. FIG. 7B shows the first fold 122, up to the point A on the adhesive strip.

FIG. 7C shows the second folding step in which the first fold 122 is folded up to the point B on the adhesive strip. This leaves a space 124 0.3 inch long between the end of the first fold and the second fold line at 126.

FIG. 7D shows the third folding step in which the second fold is folded up to the point C on the adhesive strip. This leaves a short space 128 between the end of the second fold and the third fold line at 130. The short space 124 left after the second space is shown at 124. Thus, the tube thickness after each fold is less next to the fold lines in the loose folding technique and therefore provides the advantages in folding up the dispensing tube as described previously.

Folding up and securing a tube in the above manner is more effective than rolling up the tube about itself, particularly for plastic dispensing tubes. When a collapsible dispensing tube with an adhesive strip is rolled up, there are large voids where there is little or no tube/adhesive contact, and the tube can unroll. Although not bound by theory, it is thought that this is due, in part, because the contact angle between the rolled tube and adjacent adhesive is large and variable. In contrast, the contact angle between a folded tube and an adjacent layer of adhesive is effectively zero. Additionally, because a rolled up tube tends to be thicker, the torque generated by the internal force, or resiliency, of the tube is greater than is the case when a tube is folded.

In short, a folded tube makes more adhesive contact and has less tendency to unwind than does a rolled tube.

As the diameter of the rolled end of the tube increases, it also becomes increasingly difficult to remove release liner sections (such as the "platelets" described in the Ariz reference), because the rolled tube tends to obstruct the sections. Additionally, more release liners (or platelets) are required. In contrast, a dispensing tube equipped with a perforated release liner of the present invention is easy to use; the consumer folds the tube so as to avoid overlap with successive release liner sections.

It will be noted that the distinction between "folding" and "rolling" blurs as the number of release liner sections is increased. Thus, a tube equipped with an adhesive strip and a release liner divided into many sections (e.g., the device shown in the Ariz reference) is not as convenient to use as a tube equipped with a release liner divided into only a few sections, for the reasons just described. Preferably, the release liner is divided into three or four, more preferably three, sections.

While the invention has been described with respect to its preferred embodiments, it is not limited thereto. Those skilled in the art will recognize that modifications can be made to the invention without departing from its essential spirit and scope. Therefore, the invention is not limited by the above disclosure, but only by the following claims.

What is claimed is:

1. The combination of a collapsible plastic dispensing tube, and means for maintaining the collapsible dispensing tube in a folded position, comprising:

a strip of adhesive material having upper and lower surfaces, the lower surface being secured along a majority of the length of the tube and across a majority of the width of the tube, and a release liner removably attached to and covering the upper surface of the strip, comprising a plurality of adjacent release liner sections, divided into a sequence of separate, independently removable sections adjacent one another along the length of the tube, each section having a pair of opposed lateral edges and at least one tab extending from a lateral edge, wherein each release liner section is detachable from the upper surface of the strip of adhesive material by grasping a separate tab extending from each section and peeling the section off the strip, the tube being adapted for sequential folding by detaching each release liner section in sequence to expose a corresponding flat, elongated adhesive upper surface portion in the sequence, followed by folding the tube up to the vicinity of the next release liner in the sequence to produce a plurality of elongated flat folds adhesively secured to each other in the sequence progressing along the length of the folded plastic tube, the release liner having a maximum of four adjacent release liner sections to be removed for producing such flat folding along a majority of the length of the tube.

2. The combination as recited in claim 1, further comprising a second release liner removably attached to the lower surface of the strip, including the tabs which contain an adhesive bottom surface.

3. The combination as recited in claim 1, comprising three adjacent release liner sections.

4. The combination of a collapsible plastic dispensing tube and means for maintaining the collapsible dispensing tube in a folded position, comprising:

a strip of adhesive material having an upper surface and a lower surface, said lower surface being attached lengthwise to the dispensing tube along a majority of the length of the tube and across a majority of the width of the tube, and a release liner removably attached to and covering the upper surface of the strip, comprising three adjacent release liner sections, divided into separate independently removable sections, each section having a pair of opposed lateral edges and a tab extending from a lateral edge, wherein each release liner section is detachable from the upper surface f the strip of adhesive material by grasping a separate tab extending from said section and peeling the section off the strip, the tube being adapted for sequential folding by detaching each release liner section in sequence to expose a corresponding flat, elongated adhesive upper surface portion in the sequence, followed by folding the tube up to the vicinity of the next release liner section in the sequence to produce a plurality of elongated flat folds adhesively secured to each other in the sequence progressing along the length of the folded plastic tube.

5. The combination as recited in claim 4, wherein a release liner section at one end of the release liner has a second tab extending from its free end.

6. The combination as recited in claim 4, further comprising a second release liner, removably attached to the lower surface of the strip.

7. The combination of a plastic dispensing tube and means for use in folding the tube by a flat folding technique to remove the contents of the tube, comprising an elongated strip of pressure-sensitive adhesive affixed lengthwise to the side of the dispensing tube, and separate release liners disposed side-by-side and covering the adhesive strip and removable therefrom individually along the length of the strip, progressing from a first end toward an opposite second end of the tube, to expose contiguous first, second and third sections of the adhesive strip, which contiguous sections extend a majority of the length of the tube, the first section of the adhesive strip being closest to the first end of the tube, the tube being foldable to define a first flat fold held in place by self-contact of the adhesive on said first adhesive section, the second adhesive section having a length slightly longer than the first fold so the tube can be folded to form a second flat fold in which the first fold is attached to the second adhesive section by self-contact of the first fold to near the end of the second adhesive section most remote from the first end of the tube, the third adhesive section having a length slightly longer than the second section so the tube can be folded to form a third flat fold in which the second fold is attached to the third adhesive section by self-contact of the second fold to near the end of the third adhesive section most remote from the first end of the tube.

8. The combination according to claim 7 in which the tube is foldable about the middle of the first adhesive section to define the first flat fold.

* * * * *